US005937231A

United States Patent [19]

Aslam et al.

[11] Patent Number: 5,937,231

[45] Date of Patent: Aug. 10, 1999

[54] FUSER FOR REPRODUCTION APPARATUS WITH MINIMIZED TEMPERATURE DROOP

[75] Inventors: Muhammed Aslam, Rochester; Robert D. Bobo, Ontario; Jerry E. Livadas, Webster, all of N.Y.

[73] Assignee: Eastman Kodak Company, Rochester, N.Y.

[21] Appl. No.: 09/197,296

[22] Filed: Nov. 20, 1998

[51] Int. Cl.[6] ..... G03G 15/20

[52] U.S. Cl. ..... 399/69; 399/328; 219/216

[58] Field of Search ..... 219/216, 243; 399/69, 70, 328, 330, 331, 332

[56] References Cited

U.S. PATENT DOCUMENTS

| | | |
|---|---|---|
| 4,162,847 | 7/1979 | Brandon . |
| 4,920,250 | 4/1990 | Urban . |
| 4,949,131 | 8/1990 | Ito . |
| 5,070,231 | 12/1991 | Bacus et al. . |
| 5,210,580 | 5/1993 | Aslam et al. . |
| 5,212,528 | 5/1993 | Matsuda . |
| 5,436,430 | 7/1995 | Baruch et al. . |
| 5,602,635 | 2/1997 | Domoto et al. . |

*Primary Examiner*—Arthur T. Grimley
*Assistant Examiner*—Hoang Ngo
*Attorney, Agent, or Firm*—Lawrence P. Kessler

[57] ABSTRACT

A fuser, for a reproduction apparatus, having at least one heated fuser roller operating at a setpoint temperature to permanently fix a marking particle image to a receiver member, and a mechanism for controlling temperature droop in the heated fuser roller. The temperature droop controlling mechanism includes a heat sink having a thermal mass selected to substantially match the heat take out rate for the nominal fuser operating process, the heat sink being movable to a position in operative contact with the heated fuser roller and a nonoperative position remote from heated fuser roller. A logic and control unit is provided for moving the heat sink from the nonoperative remote position to the operative position contacting heated fuser roller as soon as a reproduction apparatus job run is started to remove heat from the heated fuser roller thus lowering its surface temperature from the setpoint temperature. The logic and control unit then causes the fuser roller heating device to be turned on to bring the heated fuser roller surface temperature back up toward the setpoint temperature. Subsequently, when the first receiver member to be fused reaches the heated fuser roller, the logic and control unit causes the heat sink to move to the nonoperative position remote from the fuser roller, whereby temperature droop in the fuser roller is minimized.

6 Claims, 1 Drawing Sheet

FUSER FOR REPRODUCTION APPARATUS WITH MINIMIZED TEMPERATURE DROOP

CROSS-REFERENCE TO RELATED APPLICATIONS

U.S. Ser. No. 09/197,734, filed Nov. 20, 1998, entitled "MAXIMIZING IMAGE GLOSS UNIFORMITY BY MINIMIZING THE EFFECT OF TEMPERATURE DROOP IN A FUSER FOR REPRODUCTION APPARTUS".

U.S. Ser. No. 09/197,365, filed Nov. 20, 1998, entitled "FUSER FOR REPRODUCTION APPARATUS WITH MINIMIZED TEMPERATURE DROOP".

U.S. Ser. No. 09/197,686, filed Nov. 20, 1998, entitled "FUSER FOR REPRODUCTION APPARATUS WITH MINIMIZED TERMPERATURE DROOP".

FIELD OF THE INVENTION

The present invention relates in general to a fuser for a reproduction apparatus, and more particularly to a reproduction apparatus fuser which exhibits minimized temperature droop.

BACKGROUND OF THE INVENTION

In typical commercial reproduction apparatus (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There the image is fixed to the receiver member by heat and/or pressure from the fuser apparatus to form a permanent reproduction thereon.

One type of fuser apparatus, utilized in typical reproduction apparatus, includes at least one heated roller and at least one pressure roller in nip relation with the heated roller. The fuser apparatus rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

When the reproduction apparatus is in the standby mode between job runs, the heated fuser roller will be in a substantially equilibrium condition; that is, there is at most only a small temperature gradient between the outer surface of the fuser roller and the inner core. Then when the job run begins energy (heat) is removed from the fuser roller to the copies being fused. As a result, the temperature at the outer surface of the fuser roller droops very quickly. Since the temperature droops from the operating setpoint, the logic and control for the reproduction apparatus turns on the fuser heating device. However, depending upon the thickness of the fuser roller, there is a time lag until the fuser roller surface receives enough energy to get back to the desired fusing temperature. During the time lag, the droop in surface temperature causes inferior fusing quality. When the reproduction apparatus is a process color machine, the temperature droop results in objectionable lower saturation of colors and image gloss.

To overcome fuser roller temperature droop at the start of a reproduction run, some apparatus include temperature control algorithms that raise the fuser roller temperature at the start of the run above the run temperature set point. That is, the energy input is started earlier so that the temperature droop from the setpoint is minimized. However, this causes the fuser roller temperature to be higher at the start of a job run than the desired setpoint and lower at the bottom of the temperature droop. Therefore, the copies over a job run will be fused at differing temperatures and have differing image quality appearance.

SUMMARY OF THE INVENTION

In view of the above, this invention is directed to a fuser, for a reproduction apparatus, having at least one heated fuser roller operating at a setpoint temperature to permanently fix a marking particle image to a receiver member, and a mechanism for controlling temperature droop in the heated fuser roller. The temperature droop controlling mechanism includes a heat sink having a thermal mass selected to substantially match the heat take out rate for the nominal fuser operating process, the heat sink being movable to a position in operative contact with the heated fuser roller and a nonoperative position remote from heated fuser roller. A logic and control unit is provided for moving the heat sink from the nonoperative remote position to the operative position contacting heated fuser roller as soon as a reproduction apparatus job run is started to remove heat from the heated fuser roller thus lowering its surface temperature from the setpoint temperature. The logic and control unit then causes the fuser roller heating device to be turned on to bring the heated fuser roller surface temperature back up toward the setpoint temperature. Subsequently, when the first receiver member to be fused reaches the heated fuser roller, the logic and control unit causes the heat sink to move to the nonoperative position remote from the fuser roller, whereby temperature droop in the fuser roller is minimized.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

The FIGURE is a side elevational view of a reproduction apparatus fuser, with portions removed to facilitate viewing, the fuser having a temperature droop control mechanism according to this invention.

DETAILED DESCRIPTION OF THE INVENTION

Figure 1:
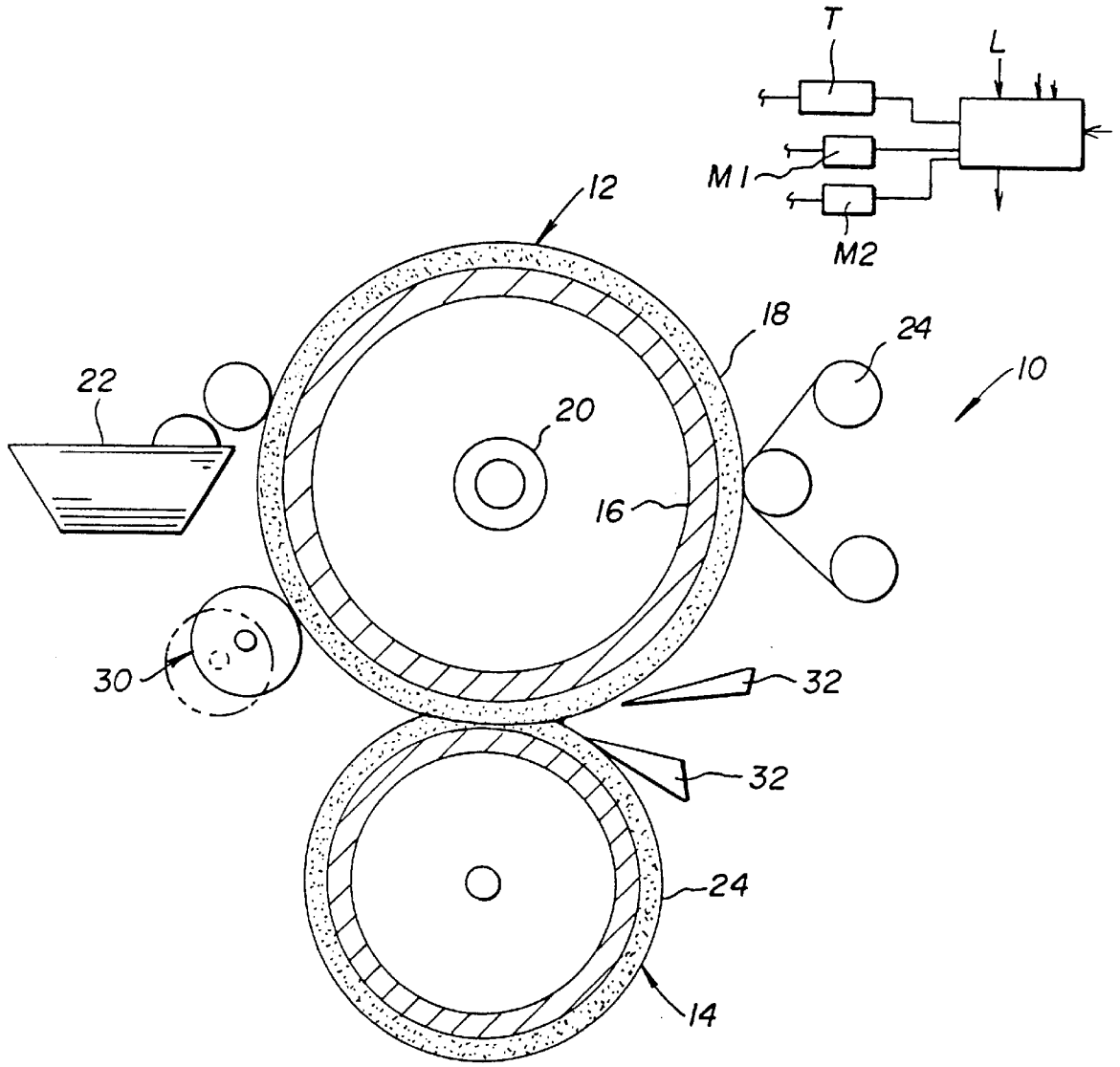

Referring now to the accompanying drawings, a typical reproduction apparatus fuser, designated generally by the numeral 10, is shown. The fuser apparatus 10 includes a fuser roller 12 in nip relation with a pressure roller 14. Rotation of the fuser apparatus rollers by any suitable drive mechanism (designated as $M_1$) will serve to transport a receiver member bearing a marking particle image through the nip under the application of heat and pressure. The receiver member may be, for example, a sheet of plain bond paper, or transparency material. The heat will soften the marking particles and the pressure will force the particles into intimate contact and to be at least partially imbibed into the fibers at the surface of the receiver material. Thus, when the marking particles cool, they are permanently fixed to the receiver member in an image-wise fashion.

The fuser roller 12 includes a core 16 and a cylindrical fusing blanket 18 supported on the core. The blanket 18 is typically made of a rubber material particularly formulated to be heat conductive or heat insulative dependent upon whether the fuser heat source is located within the core 16 or in juxtaposition with the periphery of the blanket. In the illustrated preferred embodiment, the heat source is an internal heater lamp designated by the numeral 20. A well known suitable oiler mechanism 22 selectively applies an oil to the blanket 18 of the fuser roller to substantially prevent offsetting of the marking particle image to the fuser roller 12. Additionally, a suitable cleaning mechanism 24 wipes the fuser roller surface to remove excess offset preventing oil and other contaminants which would degrade the quality of the image fused to the receiver member.

The pressure roller 14 has a hard outer shell 26. Typically, the shell 26 is made of metal, such as aluminum or steel for example. The shell 26 may also have a well known suitable surface coating (not shown) applied thereto to substantially prevent offsetting of the marking particle image to the pressure roller 14. Skive mechanisms 30 and 32 are respectively associated with the fuser roller 12 and the pressure roller 14 for removing any receiver members which inadvertently adhere to the roller surfaces. Downstream of the nip between the fuser roller 12 and the pressure roller 14 is a transport device (not shown) for feeding receiver members away from the nip.

The fuser apparatus 10 is controlled by a logic and control unit L for the reproduction apparatus. The unit L receives signals, from apparatus processing stations and receiver member location sensors about the processing path, fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

In order to control fuser roller temperature droop, according to this invention, a heat sink roller 30 is provided having its longitudinal axis parallel with the longitudinal axis of the fuser roller 12. The heat sink roller 30 is supported by any well known mechanism (designated as $M_2$) for movement to an operative position in contact with the fuser roller 12 (solid line position in the FIGURE), and to a non-operative position remote from the surface of the fuser roller (phantom line position in the FIGURE). The thermal mass of the heat sink roller 30 is selected to match the heat take out rate of the nominal fuser operating process. That is, the heat sink roller will remove substantially the same heat as a nominal image bearing receiver member being fused at the nominal process speed and fusing temperature setpoints.

Accordingly, as soon as a reproduction job run is started, a signal is sent from the logic and control unit L to the mechanism $M_2$ to move the heat sink roller 30 from the nonoperative remote position to the operative position contacting the surface of the fuser roller 12. On contact, the heat sink roller immediately starts to remove heat from the fuser roller, simulating the heat removed by copies being fused. Therefore, a temperature gradient is created in the fuser roller substantially equal to the temperature gradient which would be created by copy fusing to receiver members. The heat sink roller remains in operative contact with the fuser roller 12 until the first receiver member to be fused reaches the nip of the fuser 10. At this time, the heat sink roller is moved by the mechanism $M_2$ to the nonoperative position remote from the fuser roller 12.

With the temperature droop from the operating setpoint caused by the contact of the heat sink roller 30 with the fuser roller 12, the logic and control unit L for the reproduction apparatus send a signal to a control T to turn on the fuser heating device to bring the fuser roller surface temperature back up to the desired setpoint. Thus, when the first receiver member to be fused reaches the fuser apparatus 10, the temperature droop has, for the most part, recovered. As such the temperature droop has been minimized, and the fusing temperature during the job run remains substantially at the same desired setpoint. Accordingly, the fusing quality (and thus the overall appearance quality) of the images over the job run will be substantially the same.

The invention has been described in detail with particular reference to certain preferred embodiments thereof, but it will be understood that variations and modifications can be effected within the spirit and scope of the invention.

What is claimed is:

1. A fuser, for a reproduction apparatus, having at least one heated fuser roller operating at a setpoint temperature to permanently fix a marking particle image to a receiver member, and a mechanism for controlling temperature droop in said at least one heated fuser roller, said temperature droop controlling mechanism comprising:

a heat sink having a thermal mass selected to substantially match the heat take out rate for the nominal fuser operating process, said heat sink being movable to a position in operative contact with said at least one heated fuser roller and a nonoperative position remote from said at least one heated fuser roller; and a logic and control unit for moving said heat sink from said nonoperative remote position to said operative position contacting said at least one heated fuser roller as soon as a reproduction operation job run is started to remove heat from said at least one heated fuser roller thus lowering its surface temperature from said setpoint temperature, turning on a fuser roller heating device to bring said at least one heated fuser roller surface temperature back up toward said setpoint temperature, and when the first receiver member to be fused reaches the at least one heated fuser roller, moving said heat sink to said nonoperative position remote from said at least one heated fuser roller, whereby temperature droop in said at least one heated fuser roller is minimized.

2. The temperature droop controlling mechanism according to claim 1 wherein said heat sink is a roller having a longitudinal axis parallel to the longitudinal axis of said at least one heated fuser roller.

3. A fuser, for a reproduction apparatus, for permanently fixing a marking particle image to a receiver member, said fuser comprising:

a heated fuser member operating at a setpoint temperature;

a heat sink having a thermal mass selected to substantially match the heat take out rate for the nominal fuser operating process, said heat sink being movable to a position in operative contact with said heated fuser member and a nonoperative position remote from said heated fuser member; and a logic and control unit for moving said heat sink from said nonoperative remote position to said operative position contacting said heated fuser member as soon as a reproduction apparatus job run is started to remove heat from said heated fuser member thus lowering its surface temperature from said setpoint temperature, turning on a fuser member heating device to bring said heated fuser member surface temperature back up toward said setpoint temperature, and when the first receiver member to be fused said heated fuser member, moving said heat sink to said nonoperative position remote from said fuser member, whereby temperature droop in said fuser member is minimized.

4. The reproduction apparatus fuser according to claim 3 wherein said heated fuser member is a roller.

5. The reproduction apparatus fuser according to claim 4 wherein said heat sink is a roller having a longitudinal axis parallel to the longitudinal axis of said heated fuser roller.

6. In a fuser, for a reproduction apparatus, having at least one heated fuser member operating at a setpoint temperature to permanently fix a marking particle image to a receiver member, a method for controlling temperature droop in said heated fuser member, said temperature droop controlling method comprising the steps of:

moving a heat sink having a thermal mass selected to substantially match the heat take out rate of the nominal fuser operating process from a nonoperative remote position to the operative position contacting said heated fuser member as soon as a reproduction apparatus job run is started to remove heat from said heated fuser member thus lowering its surface temperature from the setpoint temperature;

turning on the fuser heating device to bring the fuser roller surface temperature back up toward the setpoint temperature; and when the first receiver member to be fused reaches the said fuser roller, moving said heat sink to a nonoperative position remote from said heated fuser member whereby temperature droop in said heated fuser member is minimized.

* * * * *